United States Patent [19]

Kuechler et al.

[11] 4,354,462

[45] Oct. 19, 1982

[54] INTERNAL COMBUSTION ENGINE

[76] Inventors: Jürgen Kuechler, An den alten Graeben 9, D-3556 Weimar, Lahn 2, Fed. Rep. of Germany; Reinhold Gäbler, deceased, late of Marburg an der Lahn, Fed. Rep. of Germany; by Inge Funk née Gäbler, legal representative, Piegenstrasse 43, D-3550 Marburg, Fed. Rep. of Germany

[21] Appl. No.: 97,187

[22] Filed: Nov. 26, 1979

[30] Foreign Application Priority Data

Nov. 28, 1978 [DE] Fed. Rep. of Germany ..... 2851346

[51] Int. Cl.[3] ..... F02B 53/00

[52] U.S. Cl. ..... 123/241; 418/174

[58] Field of Search ..... 123/241, 243, 240; 418/172, 174

[56] References Cited

U.S. PATENT DOCUMENTS

| | | | |
|---|---|---|---|
| 917,165 | 4/1909 | Sella | 123/243 X |
| 1,618,806 | 2/1927 | Bullard | 123/241 |
| 1,769,822 | 7/1930 | Blackman | 418/146 X |
| 2,864,346 | 12/1958 | Taylor | 123/243 X |
| 3,572,985 | 3/1971 | Runge | 123/240 X |
| 3,747,573 | 7/1973 | Foster | 123/243 X |

FOREIGN PATENT DOCUMENTS

| | | | |
|---|---|---|---|
| 813450 | 2/1937 | France | 123/243 |
| 912919 | 5/1946 | France | 418/174 |

*Primary Examiner*—Michael Koczo, Jr.
*Attorney, Agent, or Firm*—Fred Philpitt

[57] ABSTRACT

The internal combustion engine of the invention has a stationary cylindrical casing with inlet and outlet openings for fuel and air supply and for exhausting. Between two cover plates, a ring structure and a rotor enclosed thereby are arranged for rotation about different but parallel and stationary axes. The ring structure comprises a number of arcuate members between which an equal number of swinging fulcrum slides are held. Vanes extending through the fulcrum slides define an inner group of chambers between the ring structure and the rotor to whose periphery the vanes are joined by swivel bearings, and an outer group of chambers between the ring structure and the casing wall. A flow connection is provided from the outer group serving as charging and boosting chambers to the inner group in which compression, ignition and exhaustion take place. As the axes of rotation are displaced but both groups of chambers are maintained in synchronous rotation by means of a special gear, the vanes perform phase-variable, accelerated and decelerated motions; the volume of all the chambers varies accordingly. Every single chamber completes a full cycle during each revolution, and thus the engine performs a number of full cycles per revolution depending on the number of chambers in the inner and outer group.

7 Claims, 8 Drawing Figures

INTERNAL COMBUSTION ENGINE

FIELD OF THE INVENTION

Figure 1:
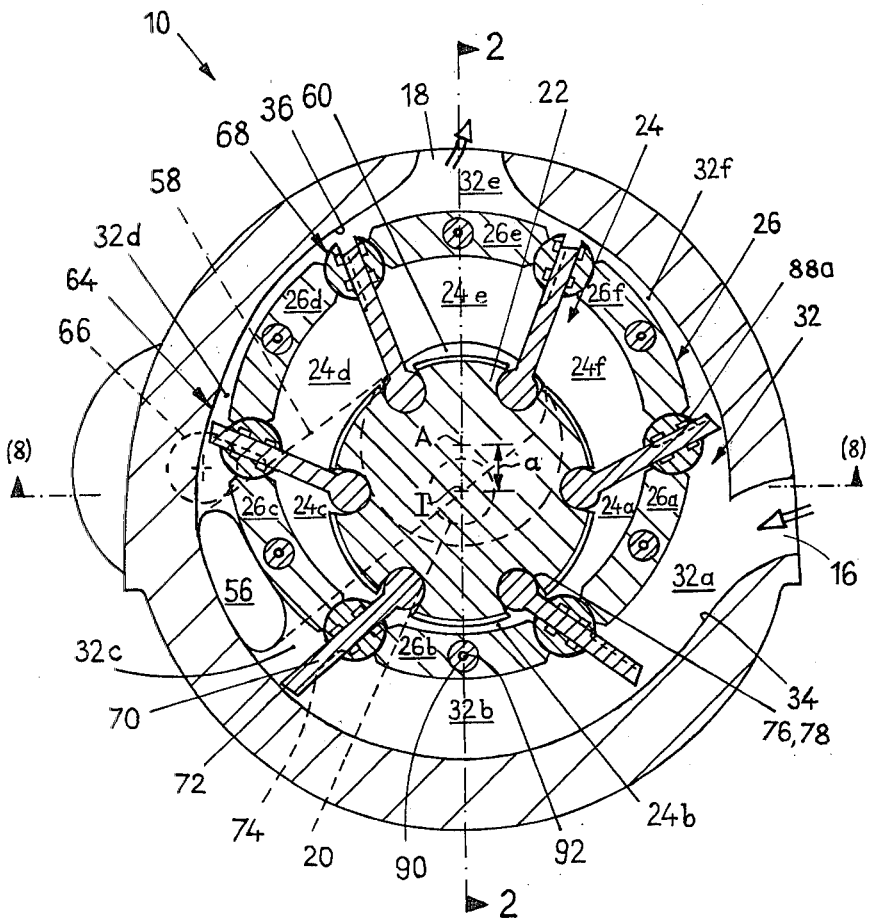

The present invention relates to an internal combustion engine having a stationary, substantially cylindrical casing that is provided with inlet and outlet openings for fuel and air supply and for exhausting, respectively, and with top and bottom cover plates in which there are bearings for a shaft carrying a rotor with a plurality of vanes defining chambers of variable volume, the vanes passing through fulcrum slides in a ring structure that surrounds the rotor so as to separate and seal an inner group of chambers from an outer group of chambers, the ring structure being arranged for synchronous rotation about an axis parallel to that of the rotor, the two groups of chambers having flow communication at predetermined peripheral zones, including ignition means for igniting a combustible gas mixture in the smallest chamber.

BACKGROUND OF THE INVENTION

A conventional engine of this type has, inside a stationary casing, a rotary group of pistons comprising an inner rotor of stacked ring disks to each of which a radial vane is rigidly attached. An outer ring is provided with arcuate members separated by fulcrum slides which guide the vanes whose tips sealingly graze the inner casing wall. This is disadvantageous in view of thermal expansion and is also cause for rapid deterioration even at moderate speeds, necessitating large maintenance and repair expenditures. Another drawback of the conventional engine is that boosting is effected in a system of inner ring chambers, whereas compressing takes place in an outer group of chambers. Though this arrangement would seem to facilitate cooling, its volume conditions entail the stiff price of rather poor compression and thus low overall efficiency. The power-to-weight ratio is relatively small, too.

Other prior art internal combustion engines of somewhat similar types feature a crank mechanism or eccentric shaft borne in a stationary casing. A rotor is provided with chambers defined by vanes which are moved, by the eccentric mechanism, both radially and shuttlewise in slit guides. The oscillatory movement of such a rotary piston array produces compression much like a cylindrical piston, although additional angular motions occur. These designs are, however, quite prone to trouble in respect of sealing as well as wear and tear. Most harmful is the vibratory flyweight due to large unbalanced masses going to and fro.

OBJECTS OF THE INVENTION

It is an object of the invention to improve, by simple and economical means, on the design of internal combustion engines of the types described above towards more favorable power-to-weight ratios with a structure as low-priced as possible.

Another object of the invention is, in such engines, the use of reliable components only that have proved to stand long-term strain and to thus obtain a rugged, well-arranged construction.

A further object of the invention consists of employing a design that requires sealing substantially for oscillating parts only in order to reduce wear and tear.

Yet another object of the invention is to create an engine of the afore-mentioned type that will run smoothly at a wide range of speeds and torques.

SUMMARY OF THE INVENTION

Basically, these objects are attained in an internal combustion engine of the type cited initially by the improvement wherein the outer group of chambers forms a boosting system and the inner group of chambers forms a compressing system, wherein said ring structure is adapted to rotate about a first stationary axis and said rotor is adapted to rotate about a second stationary axis, wherein a common driving means is joined to said ring structure and said rotor so as to maintain them in synchronous rotation, said rotor being provided with swivel bearings for said vanes to move in a phase-variable rotatory relation thereto, and wherein slide-sealing means are provided for said vanes whereby they are sealed along said top and bottom plates and between said fulcrum slides which are tiltable, whereas the tips of said vanes are spaced from the inner wall of said cylindrical casing.

Such engines can be produced at relatively low cost. The outer ring group of chambers provides proper boosting for enhancing high compression in the inner group of chambers. As each ring system comprises a plurality of chambers, there will be several cycles per revolution, partly in an overlapping time-relationship. In a most simple way, a very smooth rotation is thus achieved, with power and torque take-off being continuous and practically constant. The inner rotor on the one hand and the ring structure enclosing it on the other hand rotate about different centers, but synchronously; this results in the fact that merely the vanes are tilted in a displacement motion of variable phase relationship relative to the two ring systems. In several positions of the outer group of chambers, the vanes will operate similar to those of a fan blower, whereas in the inner group, they serve for defining the chamber volumes and for compresssing only. Owing to the relatively small mass of the vanes and to their partly opposed motions, the overall unbalance is reduced to a true minimum so that the engine according to the invention is distinguished by an exceedingly smooth operation.

The design of the present invention requires little space and can, therefore, be made very compact; it also warrants a sturdy bearing arrangement.

In one embodiment, the movement of both ring systems is economically synchronized and the shaft of the double-disk toothed wheel can serve for power take-off. Identical toothed wheels can be used. However, for certain applications it is contemplated by the invention to employ toothed wheels and/or a double-disk toothed wheel of different diameters and/or different axial spacings, i.e. to provide step-up or step-down gears which must merely satisfy the condition that they maintain the two ring systems in a synchronous but phase-variable rotation. Independent protection is sought for this general arrangement.

One embodiment specifies a flow connection between the outer and inner group of chambers. Instead or additionally, a direct supply duct for air and/or for boosted combustible gas mixture may be provided. The flow connection will serve to convey air or gas taken in through the inlet opening (manifold) to the inner group of chambers. A lunate passage will admit the boosted air-fuel mixture into the revolving chambers of the inner ring group for further compression subsequently.

Ignition will be effected in the smallest chamber by suitable means. For spark-ignition engines, this will be a plurality of spark plugs, one plug each being inserted in every arcuate member of the ring structure such that the plug head will be contacted when it passes under a contactor attached to the associated casing plate. For Diesel engines, correspondingly arranged glow plugs will aid starting, while the high degree of compression in the smallest inner chamber will provide self-ignition temperatures during operation.

Slide-sealing means are important for obtaining proper boosting and compression in the outer and inner groups of chambers, respectively, with a minimum of deterioration even under unfavorable conditions. Scavenging is much facilitated by the present invention. Following maximum compression and ignition, gas expansion takes place in the enlarging inner chambers during about one third of a revolution. Owing to rapid increase of volume under the combustion pressure, a very even torque characteristic is obtained. Towards the end of this expansion "stroke", an angular position is reached where the vane recess will progressively open the respective radial passage in the associated fulcrum slide so that the gas pressure is quickly relieved and the exhaust gas drained.

The swivel bearings for the vanes are designed in a very simple manner. Due to the spacing of the parallel axes of rotor and ring structure, the vanes continuously change their angular positions during each engine revolution. Where rotor and ring structure approach each other, the vanes begin far back with an accelerated motion in which they swing from a lagging position into an advanced one at the entrance of the intake so that the air or air-fuel mixture taken in is additionally boosted in the outer group of chambers. By the end of the intake, an angular position is reached where rotor and ring structure diverge again so that the vanes, which glide back in the fulcrum slides, are progressively retarded at their tips until the maximum lag is attained when exhaustion is completed.

The tips of the vanes may be undercut as so; they pass the inner casing wall without touching it. Preferably, the exhaust recess is formed in the rear or lagging face of each vane and shaped to provide flow-enhancing gas discharge, possibly with the aid of baffles. The vane swivel bearings may be connected to a lubricating and/or coolant system in order to achieve a relatively uniform distribution of temperature along with effective heat dissipation from within and with preheating the intake so that boosting and compression will be intensified.

The invention would appear to be of particular advantage in that the available space is fully utilized and the engine especially compact.

IN THE ANNEXED DRAWINGS

Figure 2:
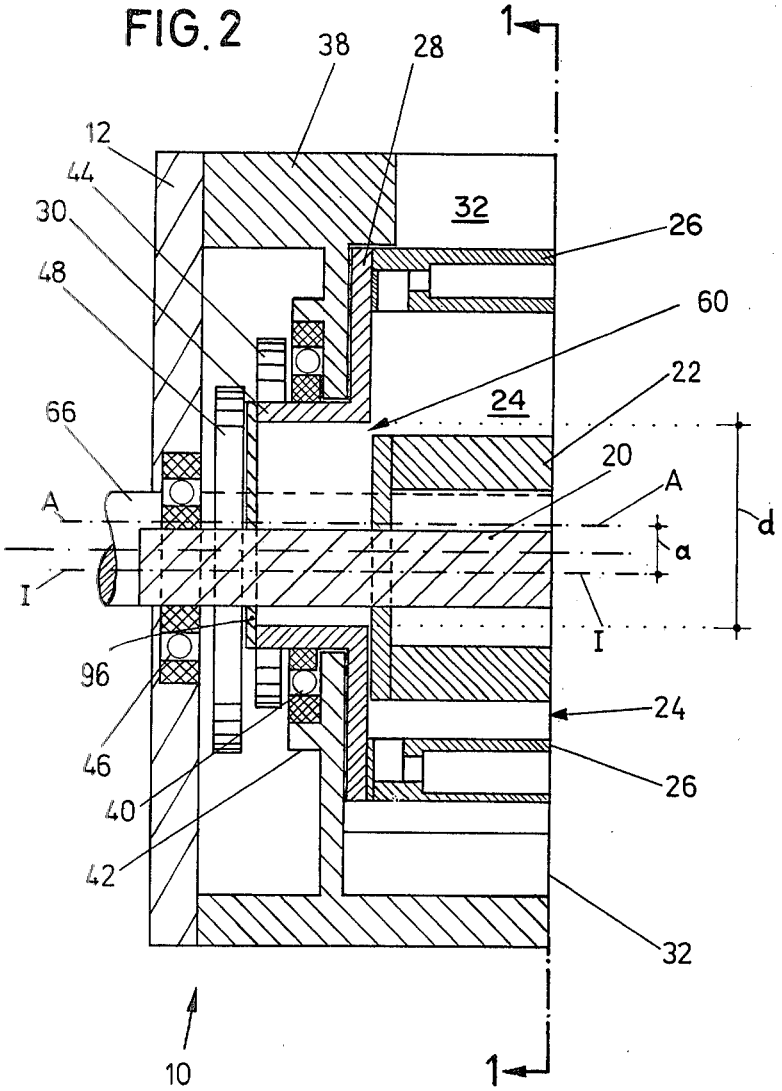
Figure 3:
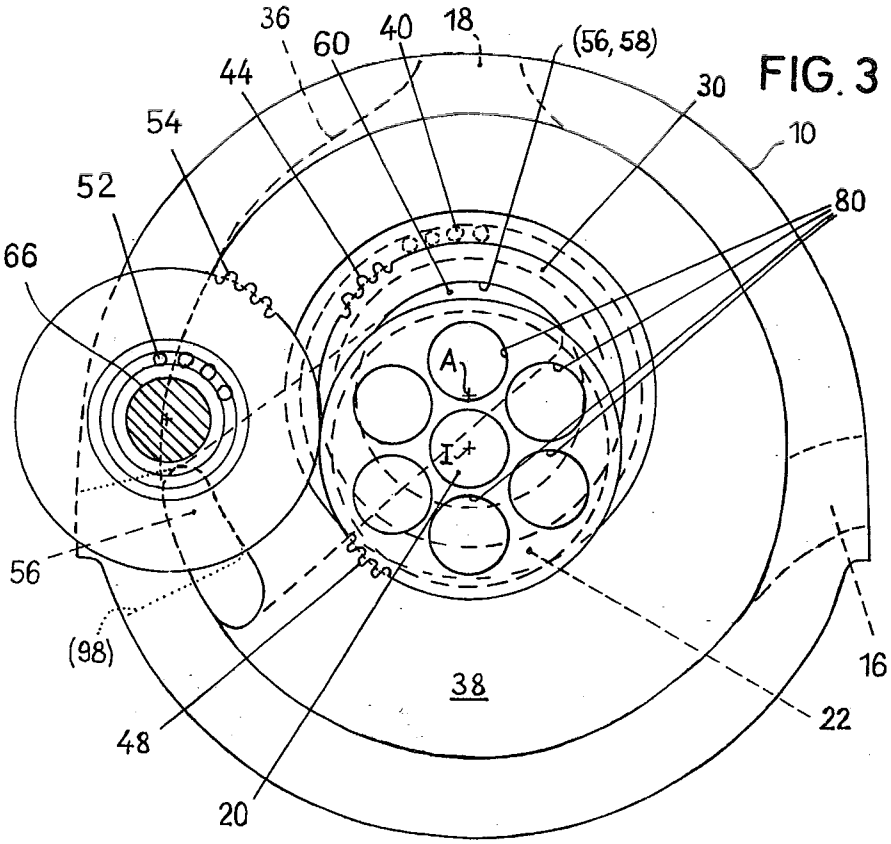
Figure 5:
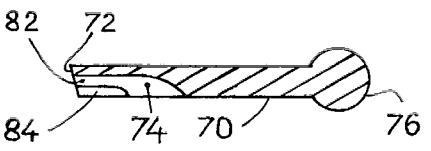
Figure 4:
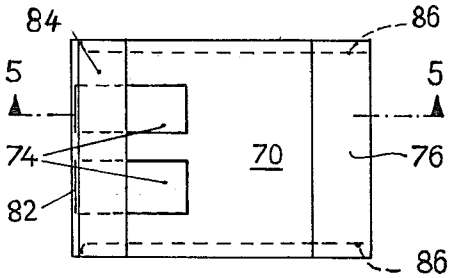
Figure 6:
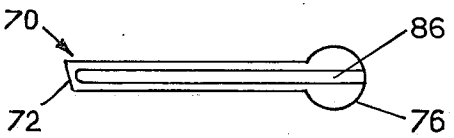
Figure 7:
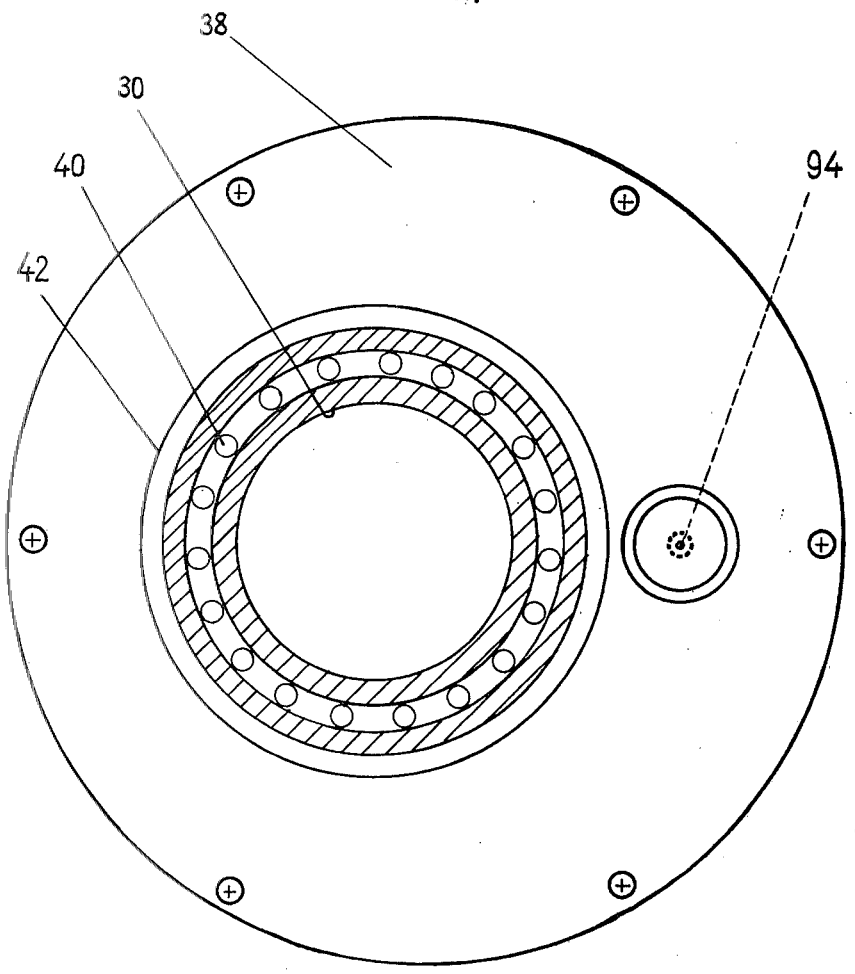
Figure 8:
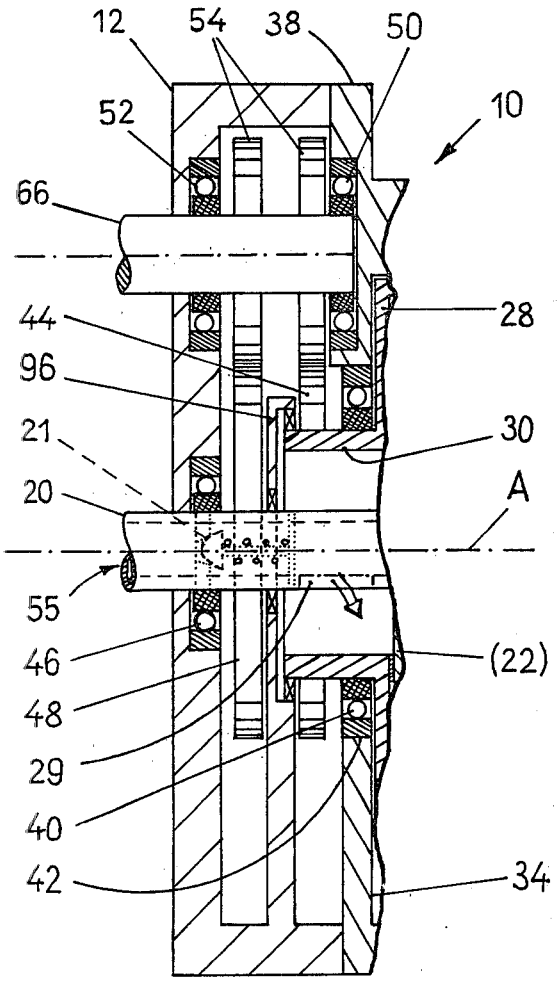

FIG. 1 shows a cross section, resembling a view taken along line 1—1 in FIG. 2, through an internal combustion engine according to the invention, FIG. 2 is a partial axial cross section resembling a view taken along line 2—2 in FIG. 1, FIG. 3 is a front elevation on an engine according to the invention, with the cover plate removed, FIG. 4 shows a side elevation of a vane, FIG. 5 is a cross section, taken along line 5—5 in FIG. 4, of the vane shown there, FIG. 6 is a front elevation of the vane shown in FIGS. 4 and 5, FIG. 7 is a front elevation of an inner plate and FIG. 8 shows a cross sectional view, resembling a view taken along plane (8)—(8) in FIG. 1, of a different embodiment of the invention.

DESCRIPTION

Casing 10 of the internal combustion engine shown comprises a bottom plate 12 and a top plate covering a central portion therebetween which includes a crown 38. Base disks 28 and flange collars 30, which may be integral, are arranged within crown 38 and serve to support a ring structure 26 in roller bearings 40 housed in bearing seats 42 (FIG. 2). Ring structure 26 is rotatable around axis A which is spaced from a parallel axis I about which shaft 20 carrying an inner rotor 22 is adapted to rotate. Shaft 20 is borne in a roller bearing 46. Rotor 22 is enclosed by ring structure 26.

Within lower plate 12, shaft 20 bears a first toothed wheel 48 that is aligned, at one point of its periphery, with an equally dimensioned second toothed wheel 44. The flange collar 30 adjacent the top plate supports the second toothed wheel 44 for rotation therewith. At the point of alignment, both toothed wheels 48, 44 mesh with a double-disk toothed wheel 54 borne on a power take-off shaft 66 which is supported in roller bearings 50, 52 near the periphery of casing 10 (FIGS. 3 and 8).

Rotor 22 is provided with swivel bearings comprising cylindrical inner ends 76 of vanes 70, which ends are pivotally fitted into cylindrical recesses 78 of rotor 22. From it, vanes 70 extend more or less radially to pass through fulcrum slides 68 which are supported, in a sealed fashion, for swivelling motion in ring structure 26. Inner wall 34 of casing 10 is not reached by the tips 72 of vanes 70 which, however, are slide-sealed against fulcrum slides 68 by means of reeds 88*a* as well as towards the top and bottom plates. Suitable sealing means are reeds in grooves 86 of vanes 70 and/or spring-biased inserts at base disks 28.

Ring structure 26 consists of arcuate members 26*a* to 26*f* the front parts of which are secured to the base disks 28. These are spaced by the axial dimension of rotor 22, and they comprise a flange collar or hub 30 at each side. The diameter of rotor 22 exceeds the clear diameters d of the flange collars 30. It will be seen that ring structure 26 is offset from rotor 22 by an axial displacement a. Therefore, and because of the diameter difference, lunate passages 60 provide a flow connection of the volume between rotor 22 and ring structure 26 with cavities in flange collars 30 at either front end.

The center of ring structure 26 being displaced from the center of rotor 22 at which the vanes 70 are pivoted, the lunate passages 60 formed by the different diameters retain a stationary position. Opposite to it, at the outside of casing 10, an outlet 18 is provided to which an inlet or intake 16 is associated in an offset relation, i.e. by about 90 to 100 degrees in circumferential direction. From an air feed line 55 and/or from a flow connection aperture 56, a tube system or a flow channel 58 in at least one of the top and bottom plates, respectively, provides flow connection between inlet 16 and passages 60. FIG. 8 shows different modes of gas feeding as will be disclosed.

Casing 10 may have an enlarged peripheral zone 36 towards outlet 18, as disclosed in FIG. 1. Consequently, the remainder of casing 10 includes a peripheral zone of a width narrower than zone 36. The narrower peripheral zone is disclosed in FIG. 1 at points of casing 10 such as the area adjacent inlet 16 and the area diametrically opposite to inlet 16 designated throat area 64. A back connection between outlet 18 and inlet or intake 16 and the adjacent volume is prevented by means of the narrower peripheral zones at said throat area 64 near power take off shaft 66 and at said area adjacent inlet 16.

Since as stated, inner rotor 22 rotates, about stationary axis I, synchronously with the enclosing ring structure 26 which rotates about the axis A that is parallel to axis I and also stationary, they form systems of chambers that are separated by the vanes 70 as slideable partitions which extend through the fulcrum slide 68 and which are tiltable around their pivots or swivel bearings (76/78) at the periphery of rotor 22. These vanes 70 thus have variable longitudinal and radial portions during the common rotation of rotor 22 and ring structure 26, and consequently they define groups of chambers of variable sizes, viz. inner chambers 24*a* to 24*f* and outer chambers 32*a* to 32*f*. Both the inner ring group of chambers 24 and the outer ring group of chambers 32 rotate within stationary cylindrical casing 10 uniformly and free of friction, apart from energy consumed in the bearings.

The cylindrical inner ends 76 of vanes 70 are pivotally fitted into matching recesses 78 of rotor 22. Each arcuate member 26*a* to 26*f* of ring structure 26 is part-cylindrically recessed at either end so as to receive, in cooperation with an opposite recessed end, a pivoted two-part cylindrical fulcrum slide 68 therebetween. The latter may comprise reeds 88*a*, possibly in a staggered radial relationship.

FIGS. 4 to 6 show embodiments of vanes 70 that are slide-sealed in the fulcrum slides 68. Each vane 70 is made up of a plane slab whose tip 72 may be undercut with respect to the sense of rotation, and of inner end 76 pivoted in the associated rotor recess 78. At its tip edge, each vane 70 has a recess 74 in the face that is lagging with respect to the sense of rotation. When passing through the associated fulcrum slide 68, such a recess forms a radial passage for exhaust flow through slits 82, possibly along exhaust gas guideways or baffles 84. At the upper and lower ends of each fulcrum slide 68 and in one embodiment (FIG. 4) also in its middle, the full vane thickness is maintained at the rear face of the vanes 70, too, for optimum guidance.

The internal combustion engine of the invention functions as follows, the sense of rotation being assumed to be clockwise.

In operation, as vanes 70 pass intake 16 and enter the channel that is formed of the adjacent chambers (in FIG. 1, chambers 32*a* to 32*c*), they undergo an accelerated movement. While the periphery of rotor 22 approaches ring structure 26, they swing from a lagging angular position into an advancing angular position. This produces a blower-like effect during part of one revolution, e.g. during about one third thereof.

Thus air or an air-fuel mixture is taken in through inlet 16. Subsequently boosting, is effected, with the gas passing either directly, by way of one or two tube ducts, to the associated passage 60 or through the channel formed by outer chambers 32*a*, 32*b*, 32*c* to flow connection aperture 56 of flow channel 58 which opens into passage 60 near the enlarged peripheral zone 36. While rotating past passage 60, the actual charging volume is filled, i.e. one or two of inner chambers 24; in the position shown in FIG. 1, inner chambers 24*e* and 24*f*.

The compression proper begins at an inner chamber that is already closed or almost closed, such as chamber 24*f* in FIG. 1, and is increased in the advanced chamber(s), e.g. chamber 24*a*. Within ring structure 26, each of the inner group of chambers 24*a* to 24*f* will reach the most narrow spot between rotor 22 and ring structure 26 and thus become the chamber of maximum compression (in FIG. 1, this is chamber 24*b*). There ignition is effected. With spark-ignition engines, a conventional distributor (not shown) will supply high tension to plugs 90, arranged in the center of each arcuate member 26*a* to 26*f*, each time when head 92 of plug 90 is contacted by a contactor 94 that is fixed to bottom plate 12 (FIG. 7). Similarly, glow plugs may be provided in the case of Diesel engines in which the inner group of chambers are dimensioned so as to effect self-ignition in the smallest chamber during normal operation. The invention also contemplates an injection-type engine having a nozzle for injection especially into lunate passage 60 or into one the the advanced inner chambers (for example, 24*f* or 24*a* or 24*b* in FIG. 1) the walls of which may include a check valve (not shown), e.g. instead of plug 90 of arcuate member 26*b* (FIG. 1). The check valve is actuated each time when the nozzle is passed.

Following combustion, the gas mixture expands and will be discharged radially or outwardly through a vane recess 74 which is open towards enlarged outlet 18 only in one phase of motion at a predetermined peripheral range of casing 10. The process is repeated with every approaching inner chamber 24 such that in it, charging, compression and combustion will take place during each revolution.

In the embodiment shown, six inner chambers 24*a* to 24*f* and six outer chambers 32*a* to 32*f* are separated by six arcuate members 26*a* to 26*f* and six vanes 70. They effect series of "strokes", viz. six cycles per revolution, comprising suction, boosting, compression, ignition, combustion, and exhaustion. Therefore, this is a quasi-continuous process involving six full combustion cycles per revolution in the inner ring chamber system.

Gas expanding after ignition, e.g. in chamber 24*c*, exerts pressure on the defining faces at the rotor periphery, at the inner arcuate member face opposite thereto, and at the vanes faces therebetween. The advancing vane face is largely responsible for taking torque and power in the next third of a revolution, the volume of the respective chamber (e.g. 24*d*) rapidly increasing as the distance between ring structure 26 and rotor 22 grows. Slightly before the angular position of vane 70 between chambers 24*d* and 24*e*, in the region of enlarged peripheral zone 36, as shown in FIG. 1, there is an angular position in which vane recess 74 will provide for exhaustion into outlet 18 to be essentially completed prior to admitting flow connection to lunate passage 60. After expansion, such flow connection will be reached at a certain angular position of each vane 70 so that residual gases will be expelled under vigorous scavenging (at the periphery location of chamber 24*e*) and fresh gas will flow in from the boosting stage (e.g. into chamber 24*f*).

It will be realized that propulsion is operative on all four chamber walls. Owing to the rapid increase of the effective vane surface area in the sense of rotation, the high pressure generated in the ignited inner chamber (e.g. 24*c*, 24*d*) is applied to rapidly increasing volumes so that a correspondingly large torque is obtained at the toothed wheels 44 and 48, respectively. For power take-off, these toothed wheels 44, 48 may have different diameters and/or different axial spacing. However, they must have equal modules, i.e. identical pitches and identical numbers of teeth, in order that rotor 22 and ring structure 26 may rotate synchronously, for the phase-variably moved vanes 70 cannot be tilted by more than the maximum angle determined by axis displacement a. Double-disk toothed wheel 54 not only serves to maintain synchronous rotation of the two ring systems (24, 32), but also to pass the torque generated to the power take-off shaft 66.

The fuel mixture fed in will keep the vanes 70 in the fulcrum slides 68 lubricated. Rotor 22 may be hollow and may include passages suited for forced coolant circulation. If pressure oil is used for the purpose, part of it may be diverted outwardly for additional lubrication elsewhere. Of particular advantage is a lubricating system warranting continuous supply of lubricant to the swivel bearings 76/78, preferably from inside the rotor 22 through a network of channels connected to the pressure oil coolant system.

The invention also provides advantageously for an axially stepped end of rotor 22 so that it is possible, as indicated in FIG. 1, to inlay a star-shaped sealing disk into an axial recess of the rotor face.

FIG. 3 points to another modification in that each of the toothed wheels 44, 48, 54 or at least one of them may be a spoked wheel or may be provided with bores 80 or other passages or reliefs. This will permit a lightweight structure, yet retain sufficient mechanical strength. It will be noted that for simplicity's sake, spur toothing has been shown in the drawings; however, spiral or helical gearing is preferred in actual practice.

The invention also contemplates making shaft 20 hollow, at least near lower plate 12, and to provide a check valve 21 as well as at least one lateral opening 29. It is thus possible to effect air feed directly to passage(s) 60. A sealing cap 96 (FIG. 8) may be joined to shaft 20 and flange collar 30, e.g. using radial packing rings or the like, in order to protect the open end of flange collar 30 against gear oil and to safeguard that the feed line 55 with check valve 21 and lateral opening 29 will convey only clean gas to the lunate passages 60. An alternative is a tube connector 98 as indicated by dotted lines in FIG. 3, leading from a boosting chamber such as 32*c* to the sealing cap 96 at flange collar 30. Thereby, precompressed gas may be fed directly to passage(s) 60.

It is a particular advantage that the internal combustion engine according to the present invention allows of very low speeds and nonetheless large torques, owing to the uniform rotation of the multiple chamber system in which a number of complete working cycles are performed during every revolution. Consequently, the field of use is very wide and most variegated.

While preferred embodiments have been illustrated and explained hereinabove, it should be understood that numerous variations and modifications will be apparent to one skilled in the art without departing from the principles of the invention which, therefore, is not to be construed as being limited to the specific forms described.

What I claim is:

1. An internal combustion engine having a stationary, substantially cylindrical casing, comprising: inlet and outlet openings for the intake of fuel and air supply and for exhausting combustion products, respectively; a rotor and a shaft; top and bottom cover plates having bearings for supporting said shaft which carries said rotor; a plurality of vanes defining chambers of variable volume, said vanes being sealed along said top and bottom plates; tiltable fulcrum slides through which said vanes pass; a ring structure that surrounds the rotor so as to separate and seal an inner group of said chambers from an outer group of said chambers, said outer group of chambers forming a boosting system and said inner group of chambers forming a compressing system, said fulcrum slides being seated in said ring structure, and said ring structure being arranged for rotation about a first stationary axis which is parallel to a second stationary axis about which the rotor is arranged for rotation, said ring structure including a base disk supporting member; swivel bearings associated with said rotor for allowing said vanes to move in a phase-variable rotatory relation thereto, the tips of said vanes being spaced from the inner wall of said cylindrical casing, said inner and outer groups of chambers having flow communication at predetermined peripheral zones; ignition means for igniting a combustible gas mixture in the smallest inner chamber; a common driving means joined to said ring structure and said rotor so as to maintain them in synchronous rotation, said common driving means including a double-disk toothed wheel meshing both with a first toothed wheel attached to said shaft and with a second toothed wheel axially spaced from said first toothed wheel and attached to the base disk supporting member of said ring structure for rotation therewith, said first and second toothed wheels having identical pitches and identical numbers of teeth, and said base disk being axially extended by a flange collar; a lunate passage being formed between the periphery of said rotor and said base disk, said lunate passage being stationary with respect to the rotating groups of chambers; and a channel formed in at least one of said top and bottom cover plates for periodical flow communication between said outer and inner groups of chambers by means of said lunate passage.

2. An engine according to claim 1 wherein said channel and said lunate passage provide flow connection between a first peripheral zone at said outer group of chambers diametrically opposite to said inlet opening and a second peripheral zone at said inner group of chambers adjacent said inlet opening.

3. An engine according to claim 1 wherein said base disk supporting member includes a flange collar portion and wherein said toothed wheels are housed in a compartment of said casing, said compartment comprising air feed means including a hollow shaft having a lateral opening adjacent said flange collar of said base disk and wherein said double-disk toothed wheel is arranged adjacent the circumference of said casing.

4. An engine according to claim 1 wherein each of said tips of said vanes is undercut and is provided with a recess adapted to form a radial passage through the associated fulcrum slide such that said radial passage is closed during part of each revolution.

5. An engine according to claim 1 wherein each of said fulcrum slides includes at least two reeds snugly fitting each plane face of the associated vane.

6. An engine according to claim 1 wherein axially adjacent said ring structure is at least one spring-biased insert for sealing said ring structure and vanes with said base disk supporting member.

7. An engine according to claim 1 wherein said casing includes a peripheral zone of increased width in the region adjacent said outlet opening and further includes a peripheral zone of narrow width adjacent said inlet opening and a similar peripheral zone of narrow width diametrically opposite to said inlet opening for preventing back connections between said outlet and inlet openings.

* * * * *